US006639508B1

(12) United States Patent
Martin

(10) Patent No.: US 6,639,508 B1
(45) Date of Patent: Oct. 28, 2003

(54) ELECTRICAL SWITCH DEVICE AND PROCESS FOR MANUFACTURING SAME

(75) Inventor: Tom O. Martin, Lake Worth, FL (US)

(73) Assignee: Aptek Williams, Inc., Sarasota, FL (US)

( * ) Notice: Subject to any disclaimer, the term of this patent is extended or adjusted under 35 U.S.C. 154(b) by 109 days.

(21) Appl. No.: 09/609,136

(22) Filed: Jun. 30, 2000

Related U.S. Application Data

(60) Provisional application No. 60/155,498, filed on Sep. 22, 1999.

(51) Int. Cl.[7] ..... H01C 10/32

(52) U.S. Cl. ..... 338/162; 338/118; 338/125; 29/610.1

(58) Field of Search ..... 338/160, 161, 338/162, 73, 86, 118, 125, 126, 153, 190; 29/610.1, 610.2, 611

(56) References Cited

U.S. PATENT DOCUMENTS

| | | | | |
|---|---|---|---|---|
| 2,827,536 A | * | 3/1958 | Moore et al. | 201/55 |
| 2,915,728 A | * | 12/1959 | Page et al. | 338/190 |
| 3,206,702 A | * | 9/1965 | Greenwood | 338/162 |
| 3,324,439 A | * | 6/1967 | Wright et al. | 338/162 |
| 4,009,238 A | | 2/1977 | Niedermeier et al. | |
| 4,168,344 A | | 9/1979 | Shapiro et al. | |
| 4,205,296 A | | 5/1980 | Frey, Jr. | |
| 4,397,915 A | | 8/1983 | Wahlers et al. | |
| 4,430,634 A | | 2/1984 | Hufford et al. | |
| 4,621,250 A | | 11/1986 | Echasseriau et al. | |
| 4,626,637 A | | 12/1986 | Olsson et al. | |
| 4,654,095 A | | 3/1987 | Steinberg | |
| 4,689,270 A | | 8/1987 | Deckelmann et al. | |
| 4,766,671 A | | 8/1988 | Utsumi et al. | |
| 4,771,263 A | | 9/1988 | Crook et al. | |
| 4,812,803 A | | 3/1989 | Hochholzer | |
| 4,824,694 A | | 4/1989 | Bosze et al. | |
| 4,825,539 A | | 5/1989 | Nagashima et al. | |
| 4,839,775 A | | 6/1989 | Schnitker et al. | |

(List continued on next page.)

OTHER PUBLICATIONS

DuPont Electronic Materials, Technical Information Brochure, 951 Low–Temperature Cofire Dielectric Tape, 3 pgs. (1994).

International Search Report, dated Mar. 1, 2001, for corresponding international application PCT/US00/40969.

Technical Publication, DuPont Green Tape™ (LTCC), pp. 1–16, Revision Jul. 15, 1998.

*Primary Examiner*—Elvin Enad
*Assistant Examiner*—Kyung Lee
(74) *Attorney, Agent, or Firm*—Brinks Hofer Gilson & Lione

(57) ABSTRACT

An electrical switch device includes a thick film switch element having a low temperature co-fired dielectric substrate, electrical conductor tracks embedded in the substrate and having a surface substantially flush with the substrate surface, and wiper contacts in sliding engagement with the conductor tracks. The switch is useful for position sensors, throttle controls, and digital encoders.

A method of manufacturing a thick film switch element includes providing a low temperature co-fired dielectric substrate in a green state, depositing an electrically conductive material onto a face of the substrate, pressing the conductive material into the substrate until the material is substantially flush with the substrate face, and then firing the substrate and conductive material.

39 Claims, 3 Drawing Sheets

U.S. PATENT DOCUMENTS

| | | | |
|---|---|---|---|
| 4,922,177 | A | 5/1990 | Mausner |
| 4,991,283 | A | 2/1991 | Johnson et al. |
| 4,994,302 | A | 2/1991 | Kellerman |
| 5,024,883 | A | 6/1991 | SinghDeo et al. |
| 5,070,728 | A | 12/1991 | Kubota et al. |
| 5,133,321 | A | 7/1992 | Hering et al. |
| 5,142,915 | A | 9/1992 | Bergstrom |
| 5,169,465 | A | 12/1992 | Riley |
| 5,258,335 | A | 11/1993 | Muralidhar et al. |
| 5,264,821 | A | 11/1993 | Vultaggio et al. |
| 5,315,239 | A | 5/1994 | Vitriol |
| 5,532,667 | A | 7/1996 | Haertling et al. |
| 5,567,874 | A | 10/1996 | Suzuki et al. |
| 5,651,180 | A | 7/1997 | Himmel et al. |
| 5,657,532 | A | 8/1997 | Alexander et al. |
| 5,661,882 | A | 9/1997 | Alexander |
| 5,708,570 | A | 1/1998 | Polinski, Sr. |

* cited by examiner

ELECTRICAL SWITCH DEVICE AND PROCESS FOR MANUFACTURING SAME

CROSS REFERENCE

This application claims benefit under 35 U.S.C. §119(e) of U.S. provisional application No. 60/155,498, filed Sep. 22, 1999.

TECHNICAL FIELD

The present invention broadly relates to contact type electrical switch devices suitable for high cycle switching applications, and deals more particularly with a method for making thick film switch elements useful for contact switches, potentiometers and encoders.

BACKGROUND OF THE INVENTION

Many low current switching applications, including electronic encoding devices, employ sliding electrical contacts, often referred to as wipers, rakes, or brushes, that cooperate with metal terminals or conductors on a planar substrate to make and break electrical circuits. These types of electrical switching devices have been long used in a variety of applications because of their high reliability and simplicity of construction. In recent years, such switching devices have found increasing use for sensing the position of a movable element relative to a reference point. For example, sensors are often used in vehicles to sense the position of an accelerator pedal forming part of an electronic throttle control (ETC) system, sometimes referred to as drive-by-wire systems. In an ETC system, the accelerator pedal is electronically, rather than mechanically, linked to the vehicle's engine. This type of sensor, commonly known as a pedal position sensor (PPS), is mounted on the accelerator pedal such that it translates the rotational displacement of the pedal into an electrical signal that is proportional to pedal position. This signal is delivered to the engine's ECU (electronic control unit) which in turn controls fuel delivery to the vehicle's engine. Rotary position sensors are also mounted on engine throttle bodies to sense the actual position of the carburetor throttle plate. Like PPSs, throttle position sensors (TPSs) are subject to high cycling demands.

Rotary position sensors of the type described above are normally in the form of a potentiometric device, comprising one or more wiper contacts connected to a rotatable input shaft on the sensor which, in the case of a PPS, is driven by displacement of the pedal. The wipers slide over a conductor pattern deposited on a substrate such as polyamide, FR-4, thermoset or ceramic. The conductor may be a plated copper, polymer thick film silver or precious metal thick film. A resistor film of electronically conductive polymer is deposited over the conductor to form a variable resistor element. Precious metal contacts are positioned over the resistor element in a manner such that sliding movement of the wiper over the conductor pattern creates a variable potentiometric linear output that is proportional to rotational the position of the sensor's input shaft, and is thus indicative of pedal position. One type of known position sensor configuration employs a flexible polymer resistor film on which resistive tracks defining a potentiometer and/or switch are formed using conventional thick film deposition techniques. While polymer resistor films may initially have acceptably low contact resistance, with mechanical cycling, such film tends to generate high resistance wear debris that contributes to high contact resistance and eventual electrical noise. This debris is created as a result of the movable contact wipers dislodging material from the surface of the substrate. The debris material is carried along with the wiper and intermittently builds up at the interface between the wiper and the substrate.

In certain position sensor applications, it is desirable to incorporate a switched or stepped (digital) output in addition to the continuous potentiometer output. These switches are typically formed simultaneously with the potentiometer resistor circuit on a common substrate, thus permanently fixing the position of the switch contacts relative to the position of the potentiometer. Such integrated switches are used to provide control signals to transmissions or to provide signals to the vehicle's engine ECU which validate that the pedal is in either the idle or wide open throttle position. The problem of contact wear and signal noise caused by debris accumulation is particularly acute in the case of the switch circuits, in large part because the switch conductors formed on the substrate create discontinuities or steps which the contact wiper must pass over. The wiper tends to collide with the edges of the stepped conductors, increasing the likelihood that material will be dislodged from the substrate. Conductor contacts formed on, a substrate using traditional thick film deposition techniques typically create a step height of approximately 0.5 to 1.5 mils (0.0005–0.0015 inches). Even in the case of a potentiometer, the resistor that is printed on top of the thick film resistor terminations conforms to the profile of the termination below and creates a step on the resistor that the contact wiper must traverse at the mechanical end of travel. Much like the above described switch application, this step contributes to wiper contact bounce, and acts as a debris generation and accumulation site.

Although prior art position sensors of the type described above have been marginally acceptable for some vehicles applications in the past, the increasingly stringent requirements for performance and service life for future vehicle applications renders these existing sensors inadequate.

One attempted solution to the problem of contact noise and wear in high cycle switch applications is disclosed in U.S. Pat. No. 5,169,465 to Riley, issued Dec. 8, 1992. The Riley patent discloses a thick film switch element that includes a high temperature glass frit fused to a ceramic substrate. A cermet layer, typically a noble metal such as silver, having a low temperature glass matrix is fired in a conventional furnace which causes the cermet layer to sink into the glass frit layer such that the resulting thickness of the switch element layer is approximately equal to the original thickness of the glass frit layer. The exposed surface of the resulting thick film switch element product is substantially smooth, and the joint between the low temperature cermet layer and the high temperature glass frit layer is substantially uniform, i.e., flush. The thick film switch element of Riley requires tight process control over material composition and firing temperatures of both the underlying glass frit layer, and the overlying cermet layer. These more stringent process controls and the materials contribute to higher costs.

It would therefore be desirable to provide a superior sensor construction suitable for high cycle switching and encoding applications that utilizes commercially available materials and takes advantage of standard processing techniques which do not require precise control. The present invention is directed toward satisfying this need.

SUMMARY OF THE INVENTION

The present invention, in one embodiment, is directed to an electrical switch device including a switch element having a low temperature co-fired dielectric substrate, electrical conductors embedded in the substrate and having a surface substantially flush with the substrate surface, and the device including a wiper contact in sliding engagement with the electrical conductors.

The present invention, in a second embodiment, is directed to a method of manufacturing a switch element that includes providing a low temperature co-fired dielectric substrate in a green state, depositing an electrically conductive material onto a face of the substrate, pressing the conductive material into the substrate until the material is substantially flush with the substrate face, and then firing the substrate and conductive material to form the switch element.

This method embodiment of the invention has the advantages of using commercially available low temperature co-fired dielectric materials and standard thick film processing conditions. Also, because the conductive material and substrate are co-fired, only one firing step is required. These and other features and advantages of the invention will be apparent from the detailed description that follows.

DETAILED DESCRIPTION OF THE PREFERRED EMBODIMENT OF THE INVENTION

Figure 1:
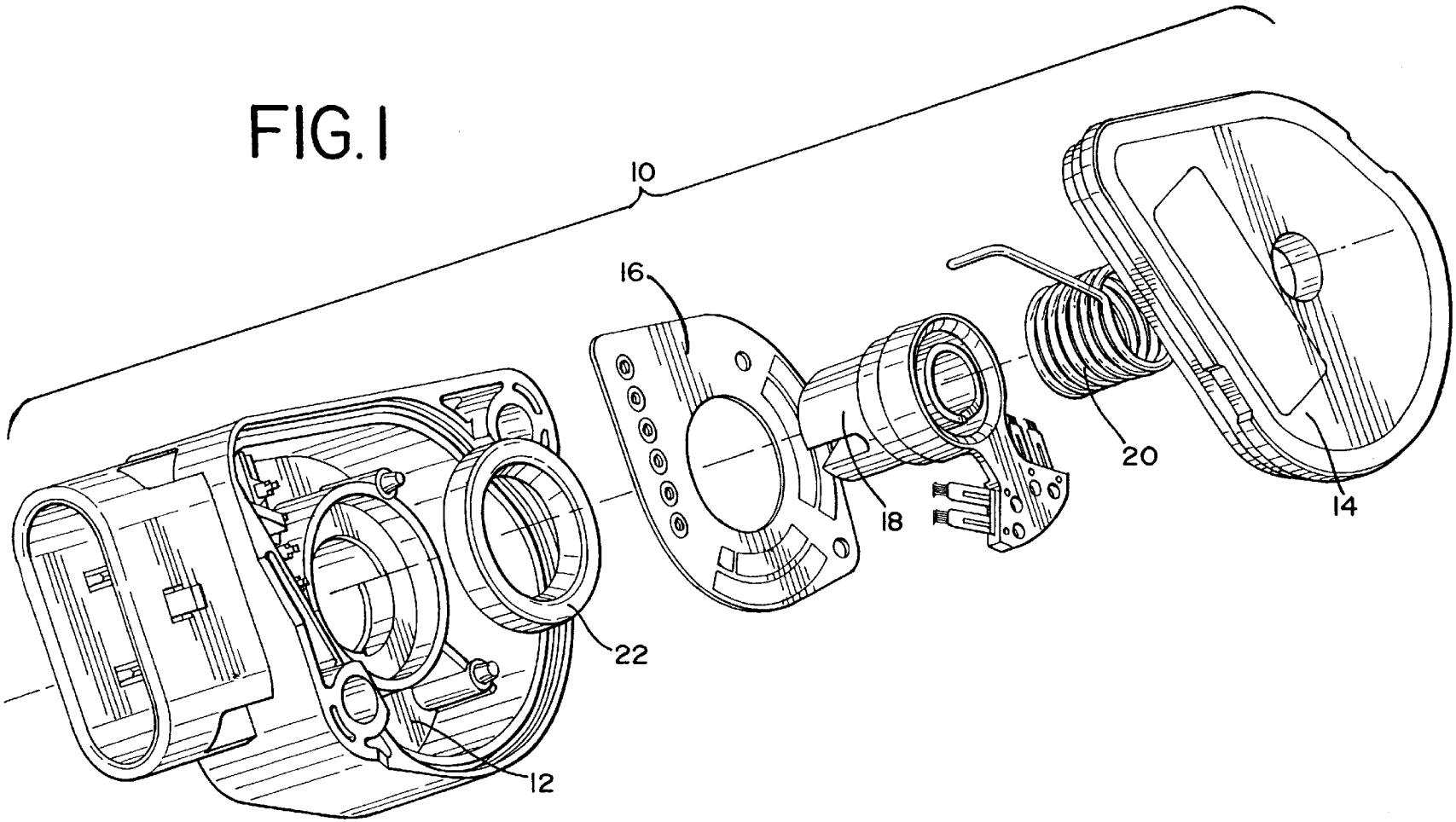
FIG. 1 is an exploded perspective view of an integrated throttle control and idle validation sensor switch.
Figure 2:
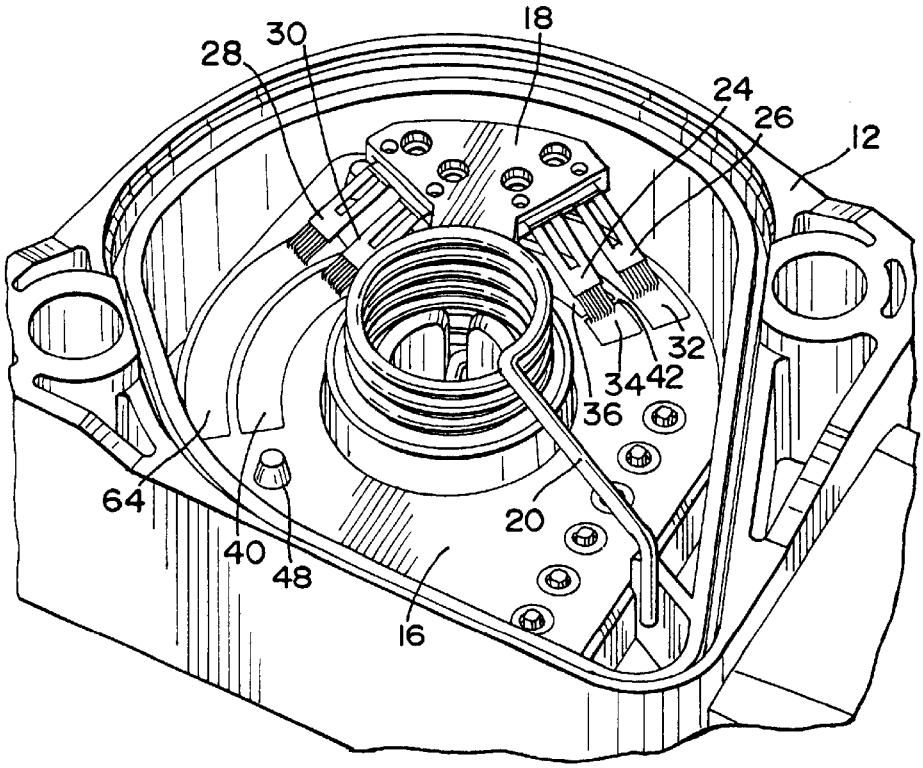
FIG. 2 is a detailed perspective view of the assembled switch element, rotor contacts and return spring of FIG. 1.

FIG. 1 depicts a preferred embodiment of the invention in the form of an integrated throttle control and idle validation sensor switch 10. That switch includes a sensor housing 12, a sensor cover 14, a switch element 16, a rotor contact 18, a return spring 20, and a rubber seal 22. As can be seen in more detail in FIG. 2, when the switch is assembled, the rotor contact 18 includes slidable contacts or wipers 24, 26, 28 and 30 that contact and slide along the electrical conductors 32, 34, 36, and 40 and resistor 64 on the switch element 16. The rotor 18 turns from the force of a mechanical linkage to a moving throttle control input device, such as an automotive accelerator pedal (not shown). The return spring 20 applies a resistive force to return the rotor 18 and the input device to a low throttle condition. Electrical conductors 32, 34 and 36 and rotor wipers 24 and 26 make up a single-pole, double-throw switch for idle validation. The narrow gap 42 between the two conductors 34 and 36 defines the idle switch point. Electrical conductor 40, resistor 64 and rotor wipers 28 and 30 make up a potentiometer with the resistor 64 including a polymer thick film resistive material layer.

The operation of an integrated throttle control and idle validation sensor switch having a switch element with this combination of switch and potentiometer functions is described in detail in U.S. Pat. No. 5,133,321 to Hering et al., issued Jul. 28, 1992, the full description of which is incorporated by reference herein. In brief, Hering et al. describe an integrated throttle control and idle validation sensor that includes mechanically coupled but electrically independent throttle control and idle validation components. A single mechanical input to the protective sensor housing corresponds to an accelerator pedal position and causes selective coupling of a supply voltage to one of an idle validation conductor and a throttle validation conductor for interpretation by an electronic control system. The throttle control system within the sensor housing comprises a potentiometer adapted for movement corresponding to the mechanical input whereby a variable voltage throttle control signal may be delivered to the electronic fuel control system. The sensor integrates previous separate throttle control and idle validation functions into a single environmentally secure housing and requires no calibration.

Figure 3:
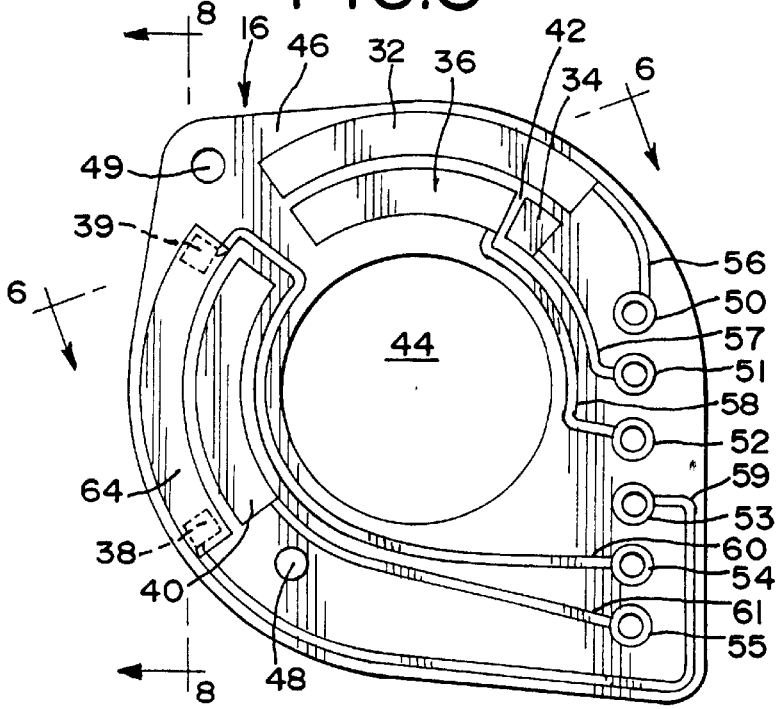
FIG. 3 is a plan view of the switch element of FIG. 1.

FIG. 3 is a plan view of the switch element 16. That switch element in this embodiment includes a glass-ceramic-type dielectric material substrate 46 supporting the electrical conductor tracks 32, 34, 36, 38, 39 and 40, a resistor track 64, the electrical terminals 50, 51, 52, 53, 54 and 55, and the corresponding electrical traces 56, 57, 58, 59, 60 and 61 connecting the electrical conductors to the appropriate terminal. There is a gap 42 between conductors 34 and 36 that corresponds to the switch transition area above the idle setting for the idle validation signal delivered to the ECU. The gap 42 should be sufficiently large enough to electrically isolate the two conductors from overlapping contact by the rotor contacts to provide a zero voltage signal to the ECU. Preferably, the gap is about 10 mils. Although, in other applications using the preferred materials, the gap between conductors may be manufactured as small as 4 mils. The polymer thick film resistor 64 overlays a conductor pad 38 and 39 at each end of the resistor. The substrate includes a hole 44 cut out of the center through which the rotor 18 is located. The substrate also includes two stake holes 48 and 49, through which a stake may pass through to hold the switch element 16 in place in the sensor housing 12. The electrical conductor and resistor tracks are arcuately shaped, preferably covering an arc angle of about 75 degrees to accommodate a mechanical input linked to the pivoting movement of the rotor 18, and to provide up to about 75 degrees of rotation over the full movement of the mechanical throttle input device.

Figure 6:
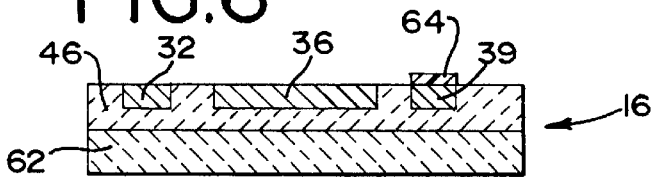
FIG. 6 is a cross-sectional view of the switch element of FIG. 3 taken along lines 6—6 after the processing is completed.

FIG. 6 depicts a cross-sectional view of the switch element 16 taken along line 6—6 of FIG. 3. The low temperature co-fire dielectric substrate 46 is shown laminated to a support sheet of dielectric material 62. The electrical conductors 32, 36 and 38 are embedded into the first dielectric substrate layer 46. A layer of polymer thick film (PTF) resistive material 64 is on a conductor 38 to form a variable resistor for a potentiometer. The top surfaces of the conductors are substantially flush with the top surface of the substrate 46. By substantially flush, it is meant that, at the joint between the conductor and the substrate, the height of the conductor surface is within about 10 microns of the substrate, preferably within about four microns. This feature prevents contact bounce, decreases wear debris formation and wear debris accumulation in the switch transition area, i.e., the gap 42, which is shown in FIG. 3. The substrate material has smooth surface, and the conductor surface is also very low roughness. The smooth surfaces decrease contact wear and resultant electrical noise.

Figure 4:
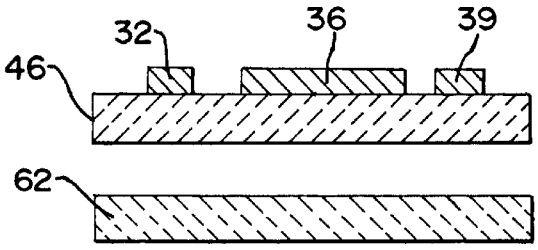
FIG. 4 is a cross-sectional view of a thick film switch element in one step of processing.
Figure 5:
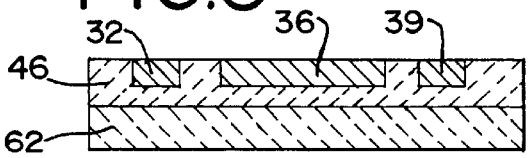
FIG. 5 is a cross-sectional view of a thick film switch element in a second step of processing.

FIGS. 4 and 5 depict the switch element in earlier stages of processing. FIG. 4 is taken at a pre-firing condition with the conductors 32, 36 and 39 having been deposited on the face of the first layer of dielectric material substrate 46 while it is still in the green state. The second supporting layer 62 of dielectric material is still separate from the first layer. FIG. 5 is taken at a subsequent stage of processing after the conductors 32, 36 and 39 have been pressed into the substrate 46, and the substrate has been laminated to the support 62. The top surfaces of the conductors are substantially flush with the top surface of the substrate 46. The overall thickness of the laminated stack is generally between about 15 and about 100 mils (i.e., about 0.015 inches and about 0.100 inches). Preferably, the overall thickness is between about 20 mils and about 40 mils. The thickness of the conductors is typically between about 10 and 15 microns after firing.

FIG. 5 is believed to be representative of both the green state condition and the fired condition of the switch element of the preferred embodiment. During firing, the materials in the switch element shrink equally in all directions (about 12 percent with the preferred materials) so that the relative geometric proportions of the conductors and substrate remain the same. After firing no gaps should appear between sides of the conductors and the substrate, and the top surfaces of the conductors should remain substantially flush with the top surface of the substrate. Accordingly, the materials used for the substrate and the conductors are preferably co-fire compatible and/or have similar shrinkage under the same firing conditions.

Figure 7:
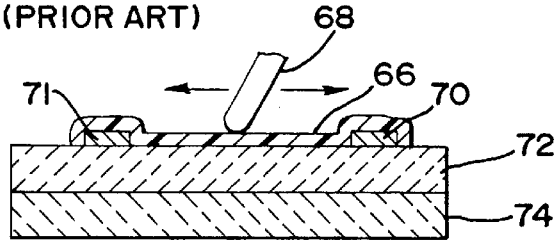
FIG.7 (PRIOR ART)
FIG. 7 is a cross-sectional view of a prior art switch element taken through a variable resistor and a wiper contact.

FIG. 7 depicts a cross-sectional view of a prior art variable resistor 66 and sliding wiper contact 68. The resistor 66 is typically a polymer thick film resistive material that is screened over the top of substrate 72. The substrate may include one or two layers 72 and 74, as shown, and typically are made from polyimide, FR-4, ceramic or other rigid materials. The conductors 70 and 71 are typically made from a precious metal alloy or a cermet, such as a Pd/Ag thick film paste. The conductors 70 and 71 are at each end of the resistor, to provide an electrical connection for the resistor. Also, the wiper 68 rides up over the conductor at the end of its travel, which provides a flat or level signal output for use as a position sensing potentiometer. As a result, in high cycling applications, the resistor material 68 can get worn, or bounce, at the step up over the conductors.

Figure 8:
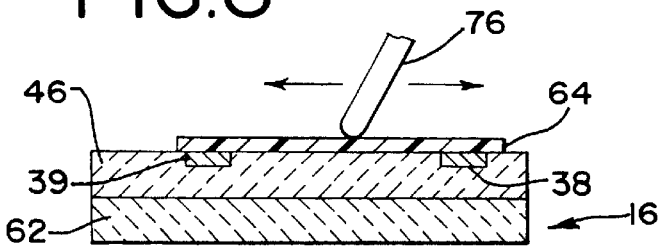
FIG. 8 is a cross-sectional view of the switch element of FIG. 3 taken along lines 8—8 and showing a wiper contact.

FIG. 8 depicts a cross-sectional view of the switch element 16 from FIG. 3 taken along lines 8—8, and shows a sliding wiper contact 76 in sliding engagement with the resistor track 64. The terminal conductors 38 and 39 are embedded in the substrate layer 46, which sits on a support layer 62. The terminal conductors 38 and 39 are substantially flush with the substrate layer 46. Because the surface is flush, the resistor track 64 is substantially planar and overlies the conductors 38 and 39 without any change in height. Thus, in contrast to the prior art device, shown in FIG. 7, the wiper contact 76 may slide over the conductors without a change in level and without causing excessive wear or bounce.

This switch element is shown in the configuration of the preferred embodiment, but a person skilled in the art may appreciate that the switch element may be manufactured in different configurations, with different terminal connections, for example, or with the electrical conductors in a straight linear shape for contact with wipers moving in a linear direction.

Having described the configuration of the preferred embodiment of the invention, it should be noted that for some of the components of the switch element 16, certain materials are preferred. The substrate 46 is preferably a low temperature co-fired dielectric material. In contrast, high temperature dielectric materials are typically ceramics that are fired at temperatures in the range of 1500° C. to 1600° C. At these relatively high temperatures, however, the noble metals used as conductors in electronic circuits will melt. Low temperature dielectric materials are generally fired at temperatures below 1000° C. Because this is less than the melting temperature of noble metals, low temperature dielectrics have found wide use in the electronics industry.

Low temperature co-fired dielectric materials, as that term is used herein, are well known in the art, and may also be known as glass-ceramic, or low temperature co-fired ceramic (LTCC). Typical LTCC dielectric materials have included $Al_2O_3$ as a refractory filler or crystalline phase in a non-crystalline glass (i.e., non-crystallizing glass/ceramic composites). An advantage of LTCC material is that it is inherently smoother and less abrasive than a standard alumina ceramic substrate, because it contains a significant volume of glass phase. Another advantage is its lower temperature for processing, which allows greater selection of metal alloys for the conductors. U.S. Pat. No. 4,654,095 to Steinberg, issued Mar. 31, 1987, teaches such a dielectric composition in the form of green tapes for use in the fabrication of multi-layer circuits. Steinberg teaches that selected non-crystallizing glass having certain deformation and softening temperatures are mixed with a refractory filler that is insoluble in the glass to make up a green tape that is then fired at between a maximum temperature about 825° C. and about 900° C.

Other types of suitable LTCC materials do not include refractory filler, but include a glass-ceramic formed by the in situ crystallization of one or more crystallizable glasses from the same glass system. Such LTCC materials include a noncrystallizing glass/glass-ceramic dielectric material wherein a ceramic phase is dispersed in a glassy matrix where the ceramic is formed by the crystallization of the glass ceramic. Unlike glass/ceramic composites where a refractory filler (ceramic) is mixed with a non-crystallizing glass in which it is insoluble to form a glassy matrix, this material includes a glass ceramic formed in situ by the crystallization of one glass in a non-crystallized matrix of another glass. Those LTCC materials are described in detail in U.S. Pat. No. 5,258,335 to Muralidhar et al., issued Nov. 2, 1993, which teaches a low dielectric, low temperature fired glass ceramic selected from the glasses of the CaO—$B_2O_3$—$SiO_2$ glass system capable of being fired at a maximum temperature between about 800° C. and about 900° C. LTCC materials of this type are lightweight, exhibit a low dielectric constant less than about 10, have adequate mechanical strength and thermal conductivity, and are compatible with precious metal conductors.

In the preferred embodiment of the present invention, the preferred low temperature co-fired dielectric material is known as 951 AX Low-Temperature Cofire Dielectric Tape, commercially available from the DuPont Company, Wilmington, Del., USA. This material is sold as a Green Tape™ System, that is, in rolls of unfired glass-ceramic tape having a thickness of about 10 mils. But for the purposes of the present invention, the LTCC material used in this invention may be any configuration, such as sheets, and may have a different thickness. It is believed that the DuPont 951 LTCC includes a glass and a refractory filler.

The electrical conductors may be precious metals or cermet materials. Preferably, the conductors are a cermet material compatible with the selected dielectric substrate material. For use with DuPont 951AX Low Temperature Co-fire Dielectric Material, it is preferred to use DuPont 6146 Co-fire Pd/Ag Conductor that is commercially available from DuPont, Wilmington, Del., USA. This conductor material is a silver/palladium cermet thick film paste designed to be compatible with DuPont 951 Dielectric material. The co-fired Pd/Ag conductor material is well suited for high duty mechanical switch cycling. In performance tests, the conductor surface shows very little wear after 10 million cycles. Since it is a precious metal alloy, it is non-oxidizing and completely compatible with the precious metal alloys used in the contact wipers. What little wear the Pd/Ag conductor exhibits is of an adhesive nature. In other words, any debris generated is immediately redeposited on the wear track. And because the debris is metallic, it does not significantly contribute to contact resistance. The Pd/Ag conductor material also exhibits excellent solderability for reliable connection to connector terminals.

The advantage of using these materials include the easy processing and well-established material properties, since those materials have been used in the electronics industry for standard thick film electronic circuitry applications.

The resistive material for the potentiometer application may be any standard polymer thick film (PTF) resistive material used in the art. Preferably, the PTF resistive material is Minoco 2000 Series, manufactured by Emerson & Cuming, a division of National Starch and Chemical Co., Canton, Mass., USA.

The wiper contacts are conventional in the industry. Preferably, the wiper contacts are made from an Ag/Pd/Cn alloy, such as Hera 649 alloy, commercially available from W.C. Heraeus GmbH & Co., Hanau, Germany. Also, the wiper contacts preferably have laser polished tips, which are also commercially available.

In one embodiment, the invention includes an electrical switch device including a wiper contact; and a switch element that includes a low temperature co-fired dielectric substrate having a top surface, at least one conductor track having a surface adapted for sliding engagement by the wiper contact. The at least one electrical conductor track is embedded into the surface of the substrate, and the surface of the substrate and the surface of the conductor track are substantially flush. Preferably, the conductor is embedded into the substrate its full height, that is, to a depth of between about 10 and 20 microns. Preferably, the conductor is composed of a cermet material that has a shrinkage during firing similar to the shrinkage of the substrate material.

In the method according to the present invention, one embodiment includes a method of manufacturing a switch element for an electrical switch having at least two electrical conductors engageable by an electrical wiper slidable over the conductors, comprising the steps of:

providing a low temperature co-fired dielectric substrate in a green state;

depositing an electrically conductive material onto a face of the substrate to form the electrical conductors;

pressing the electrical conductors into the substrate until the conductors are substantially flush with the substrate face; and then firing the substrate with the flush electrical conductors at a temperature sufficient to sinter the substrate but less than the melting point of the electrical conductors.

Preferably, that firing temperature is less than 1000° C., more preferably, less than 900° C. The method further may include the steps of depositing a polymer thick film resistive material over at least one of the electrical conductors to form variable resistor engageable by a slidable wiper contact, and then curing the polymer thick film resistive material at a temperature of about 200° C. in an air atmosphere.

Optionally, this method includes the steps of laminating a sheet of a second dielectric material against a second face of the dielectric substrate, with the second face being opposite the first face on which the electrical conductors are deposited. This lamination preferably occurs when both the dielectric substrate and sheet of dielectric material are in a green state, and preferably after the conductive material has been deposited on the first face of the substrate. Preferably, the second dielectric material is the same material as the dielectric substrate. However, one skilled in the art may appreciate that the dielectric substrate may be affixed to any rigid support after the substrate has been fired. Accordingly, unless specified otherwise, the methods described herein do not have to be performed in the order stated.

In this embodiment of this method, the co-fired dielectric substrate is preferably comprises a glass and refractory material. The electrically conductive material is preferably a precious metal, a precious metal alloy or a cermet material. More preferably, the conductive material is a Pd/Ag thick film paste. The selected materials for the substrate and the electrically conductive material preferably have a similar shrinkage during the firing step such that after firing the electrical conductors are substantially flush with the substrate surface. In connection with making a switch element for rotary wiper contacts, the electrically conductive material is preferably deposited in an arcuate shape.

In the method according to the present invention, a second embodiment includes a method of manufacturing an electrical sensor switch, of the type having a substrate, at least two electrical conductors on the substrate and spaced apart to form a gap therebetween, and a wiper contact slidable over the substrate through the gap between the conductors, comprising the steps of:

providing a first layer of low temperature co-fired dielectric substrate in a green state;

depositing an electrically conductive material on a face of the first layer of substrate in at least two spaced apart areas to form the electrical conductors having a gap therebetween; depositing electrically conductive traces on the first layer electrically connecting each of the conductors to terminals on the layer;

providing a second layer of a dielectric material in a green state; placing the first layer on the second layer with the electrical conductors remaining exposed;

pressing the first and second layers together; pressing the electrical conductors into the first layer;

firing the layers and electrical conductors; and assembling a slidable contact over the electrical conductors.

Preferably, the pressing of the electrical conductors and first layer is carried out using a pressure sufficient to press the electrical conductors into the first layer until the conductors are substantially flush with the face of the first layer. Also, the pressing of the multiple layers and conductors are preferably carried out in a single step. The materials selected for this embodiment are preferably the same preferred materials as described for the first embodiment of the method of this invention.

In the method according to the present invention, a third embodiment includes a method of manufacturing an electrical switch board having at least two electrical conductors thereon, the conductors being engageable by an electrical wiper slidable over the board to make and break a circuit containing the conductors, the method comprising the steps of:

providing a first sheet of a low temperature co-fired dielectric in a green state;

depositing an electrically conductive material onto one face of the first sheet to form the electrical conductors;

providing a second sheet of a dielectric material in a green state;

pressing the first and second sheets together with a pressure sufficient to displace the electrical conductors into the first sheet until the conductors are substantially flush with the one face; and then firing the pressed sheets.

In one example of the method according to this invention, LTCC substrate material consisting of DuPont 951 AX Green Tape in the unfired or green state is blanked into sheets. The conductor paste consisting of DuPont 6146 Pd/Ag thick film paste is deposited on the substrate, either by screening or printing, in the configuration of a single-pole, double-throw switch and a dual track potentiometer, as shown in FIG. 3. The electrical traces and terminal connection pads are also preferably made of the same conductor paste, and are also preferably deposited on the substrate at the same time as the conductor tracks. Typically, following conventional thick film fabrication procedures, the conductor paste is screened on at a thickness of 40 microns, and dries to a thickness of less than 20 microns. A second sheet of the LTCC substrate material is blanked to the same dimensions as the first, and is then uniaxially laminated to the backside of the first printed substrate layer. The lamination is carried out by pressing the two layers and conductors together in a press with 3000 psi pressure at 80° C. for 10 minutes. During the lamination step, the printed conductor layer is pressed into the surface of the substrate layer creating a smooth substantially flush, or planar, surface. After pressing, the fused stack is blanked into the desired shape corresponding to the shape of the sensor housing. The stack is then placed on a flat ceramic tile and fired in a conventional thick film furnace following a standard 875° C. temperature profile in air. The stack shrinks about 12.5%±0.1% during firing.

The amount of shrinkage is a property of the materials used, and is not a controlled variable during processing of the switch element. The co-fired Pd/Ag conductors are designed to shrink in all dimensions at the same rate as the dielectric substrate layer such that the fired surface of the switch element is substantially flush and undistorted. The difference in height between the conductors and the substrate is preferably less than four microns. The lamination or pressing step creates a smoother fired surface on both the substrate and the conductor than is achievable with conventional thick film processing.

After firing the stack, a PTF resistor paste is deposited, either by printing or screening, onto a conductor to form a potentiometer. The stack is then heated up to about 200° C. in air following conventional curing procedures for the PTF resistor material. After curing, the switch element is placed in a sensor housing and assembled together with the rotor contact and other sensor components. The switch element is heat-staked to the plastic sensor housing, but alternative means such as screws or rivets may be used to secure that element into the housing. The switch element is electrically coupled to a terminal block in the housing, and the housing is sealed to complete the assembly.

The invention has been shown and described for an integrated throttle control and idle validation sensor switch for a foot operated accelerator pedal. But it should be apparent to one skilled in the art from the teachings contained herein that the invention may be applied to a variety of control or sensing devices which may or may not have the same high cycle requirements, and may have various combinations of switches, or potentiometers, or both. Some of those devices which have wiper contacts in sliding engagement with discrete electrical conductors or resistive tracks include, but are not limited to, a digital encoder device, a throttle position sensor, an adjustable pedal position sensor, an adjustable car seat position sensor, an adjustable steering wheel position sensor (which may be used for position memory on automobiles), or steering wheel digital encoders for drive-by-wire applications. In the case of digital encoders, one such configuration may include a plurality of conductors, such as at least 50 conductors to provide a 2% resolution, formed within an arcuate boundary radially aligned about an axis of a rotary wiper, having a similar shape as and coaxially aligned with an adjacent elongated arcuate conductor track used as the collector, to provide a digital position output of a rotating mechanical input device.

It will be appreciated that the present invention is not restricted to the particular embodiments or applications that have been described and illustrated. One skilled in the art may take the teachings herein and make many variations without departing from the scope of the invention, which are defined in the appended claims and the equivalents thereof.

I claim:

1. An electrical switch device having at least two electrical conductors engageable by a wiper contact slidable over said conductors, made by the process of:

(a) providing a low temperature co-fired dielectric substrate in a green state;

(b) depositing an electrically conductive material onto a face of said substrate to form said electrical conductors;

(c) pressing said electrical conductors into said substrate until said conductors are substantially flush with said substrate face;

(d) after step (c), firing said substrate with said flush electrical conductors at a temperature sufficient to sinter said substrate but less than the melting point of said electrical conductors, wherein said electrical conductors and said substrate have a similar shrinkage during firing such that after firing said electrical conductors are substantially flush with substrate surface; and (e) assembling the electrical wiper in sliding engagement with said conductors.

2. The device of claim 1 made by the process wherein the co-fired dielectric substrate comprises glass and refractory material.

3. The device of claim 1 made by the process wherein the electrically conductive material is a precious metal alloy or a cermet material.

4. The device of claim 1 made by the process wherein the firing occurs at a maximum temperature between about 800° C. and less than about 900° C.

5. The device of claim 1 made by the process wherein the electrically conductive material is deposited in an elongated arcuate shape.

6. The device of claim 1 made by the process further comprising laminating a sheet of a dielectric material against a second face of said dielectric substrate, said second face opposing said first face on which the electrical conductors are deposited.

7. The device of claim 6 made by the process wherein the laminating occurs when both the dielectric substrate and sheet of dielectric material are in a green state.

8. The device of claim 1 made by the process further comprising before step (c) placing a sheet of a dielectric material in a green state against a second face of said dielectric substrate in a green state, said second face opposing said first face on which the electrical conductors were deposited.

9. The device of claim 1 made by the process wherein said dielectric substrate and electrically conductive material have a similar shrinkage during the firing step such that after firing the electrical conductors are substantially flush with the substrate surface.

10. The device of claim 1 made by the process further comprising depositing a polymer thick film resistive material over and between two of the electrical conductors to form a resistor.

11. The device of claim 10 made by the process further comprising curing the polymer thick film resistive material at a temperature of about 200° C. in an air atmosphere.

12. The device of claim 10 made by the process further comprising placing a second wiper contact in sliding engagement with said resistor.

13. The device of claim 1 made by the process wherein the conductors have a depth of between about 10 and about 20 microns.

14. An electrical switch device comprising:

a wiper contact; and a switch element comprising a low temperature co-fired dielectric substrate having a top surface, at least one conductor track having a surface adapted for sliding engagement by the wiper contact;

wherein the at least one electrical conductor track is embedded into the surface of the substrate, and the surface of the substrate and the surface of the conductor track are substantially flush.

15. The device of claim 14 wherein the at least one conductor is embedded into the substrate a depth of between about 10 and 20 microns.

16. The device of claim 14 further comprising two spaced apart electrical conductor pads embedded in the substrate and having a surface substantially flush with the substrate, a thick film resistor deposited over and electrically coupled with the conductor pads, wherein the wiper contact is in sliding engagement with the resistor and the at least one conductor track to form a variable resistor to provide a signal responsive to the position of the wiper.

17. The device of claim 14 further comprising at least three of said electrical conductor tracks positioned with respect to the wiper contacts and cooperating with the wiper contacts to form a single-pole, double-throw switch to provide a validation signal responsive to the position of the wiper.

18. The device of claim 17 further comprising a device housing, and a variable resistor, wherein said device is an integrated position sensor and validation device and said variable resistor and said single-pole, double-throw switch are positioned on said substrate and cooperate with said wiper contacts to provide signals responsive to a single mechanical input.

19. The device of claim 14 wherein the electrically conductive material is a precious metal alloy or a cermet material.

20. The device of claim 19 wherein the conductor track has an elongated arcuate shape.

21. An integrated position sensor and validation device, said device comprising:

(a) a device housing;

(b) a wiper inside said housing adapted for mechanical coupling to a movable object external to said housing, said wiper having a plurality of wiper contacts; and (c) a switch element inside the housing and proximate to the wiper, the switch element including:

(1) a low temperature co-fired dielectric substrate having a top surface, (2) a plurality of spaced apart electrical conductor tracks each having a surface for engagement with at least one of the wiper contacts, at least three of said electrical conductors positioned with respect to the wiper contacts and cooperating with the wiper contacts to form a single-pole, double-throw switch to provide a validation signal responsive to the position of the movable object, and at least one of said electrical conductor tracks positioned with respect to the wiper contacts to form a common collector for a variable resistor; and (3) a thick film resistor on the surface of the substrate having opposing ends disposed over electrical conductor pads and cooperating with wiper contacts in sliding engagement with the resistor and the common collector to form a variable resistor to provide a position signal responsive to the position of the movable object;

wherein the surface of the conductor tracks and the conductor pads are substantially flush with the surface of the substrate.

22. A method of manufacturing a switch element for an electrical switch having at least two electrical conductors engageable by an electrical wiper slidable over said conductors, comprising the steps of:

(a) providing a low temperature co-fired dielectric substrate in a green state;

(b) depositing an electrically conductive material onto a face of said substrate to form said electrical conductors, said material having shrinkage similar to said substrate, (c) pressing said electrical conductors into said substrate until said conductors are substantially flush with said substrate face, (d) after step (c), firing said substrate with said flush electrical conductors at a temperature sufficient to sinter said substrate but less than the melting point of said electrical conductors; and (e) placing an electrical wiper on said substrate in electrical contact with at least two of said conductors.

23. The method of claim 22 wherein the co-fired dielectric substrate comprises glass and refractory material.

24. The method of claim 22 wherein the electrically conductive material is a precious metal alloy or a cermet material.

25. The method of claim 22 wherein the firing occurs at a maximum temperature between about 800° C. and 900° C.

26. The method of claim 22 wherein the electrically conductive material is deposited in an elongated arcuate shape.

27. The method of claim 22 further comprising laminating a sheet of a dielectric material against a second face of said dielectric substrate, said second face opposing said first face on which the electrical conductors are deposited.

28. The method of claim 27 wherein the laminating occurs when both the dielectric substrate and sheet of dielectric material are in a green state.

29. The method of claim 22 further comprising before step (c) placing a sheet of a dielectric material in a green state against a second face of said dielectric substrate in a green state, said second face opposing said first face on which the electrical conductors were deposited.

30. The method of claim 22 wherein said dielectric substrate and electrically conductive material have a similar shrinkage during the firing step such that after firing the electrical conductors are substantially flush with the substrate surface.

31. The method of claim 22 further comprising the step of depositing a polymer thick film resistive material over at least one of the electrical conductors to form a resistor engageable with a slidable wiper.

32. The method of claim 31 further comprising curing the polymer thick film resistive material at a temperature of about 200° C. in an air atmosphere.

33. The method of claim 31 further comprising placing a wiper in sliding contact with said resistor.

34. A method of manufacturing an electrical sensor switch, of the type having a substrate, at least two electrical conductors on said substrate and spaced apart to form a gap therebetween, and a contactor in sliding engagement with said conductors and through said gap between said conductors, comprising the steps of:

(a) providing a first layer of low temperature co-fired dielectric substrate in a green state;

(b) depositing an electrically conductive material on a face of said first layer of substrate in at least two spaced apart areas to form said electrical conductors having a gap therebetween, said conductive material having similar firing shrinkage characteristics as said substrate;

(c) providing a second layer of a dielectric material in a green state;

(d) placing the first layer on the second layer with the electrical conductors remaining exposed;

(e) pressing said first and second layers together;

(f) pressing said electrical conductors into said first layer;

(g) firing the layers and electrical conductors;

(h) depositing electrically conductive traces on the first layer electrically connecting each of said conductors to terminals on the layer; and (i) placing a slideable contactor over said electrical conductors.

35. The method of claim 32, wherein step (f) is performed using a pressure sufficient to press the electrical conductors into said first layer until said conductors are substantially flush with said face of said first layer.

36. A method of manufacturing an electrical switch board having at least two electrical conductors thereon, said conductors being engageable by an electrical wiper slidable over said board to make and break a circuit containing said conductors, comprising the steps of:

(a) providing a first sheet of a low temperature co-fired dielectric in a green state;

(b) depositing an electrically conductive material onto one face of said first sheet to form said electrical conductors, said conductive material having similar firing shrinkage characteristics as said substrate;

(c) providing a second sheet of a dielectric material in a green state;

(d) pressing said first and second sheets together with a pressure sufficient to displace said electrical conductors into said first sheet until said conductors are substantially flush with said one face;

(e) firing the sheets laminated in step (d).

37. The method of claim 36 wherein the contacts are embedded into the substrate at a depth of about 10 microns and about 20 microns.

38. The method of claim 36 wherein the electrical conductors are positioned with a gap of about 0.01 inches between an adjacent conductor.

39. The method of claim 38 wherein a plurality of electrical conductors are formed on said substrate within an arcuate boundary adjacent to and coaxially aligned with an elongated conductor track having an arcuate shape.

* * * * *